US005142754A

United States Patent [19]

Krenzer

[11] Patent Number: 5,142,754

[45] **Date of Patent: * Sep. 1, 1992**

[54] METHOD AND APPARATUS FOR PRODUCING AN AIR TEXTURED YARN

[75] Inventor: Eberhard Krenzer, Ennepetal-Ruggeberg, Fed. Rep. of Germany

[73] Assignee: Barmag AG, Remscheid, Fed. Rep. of Germany

[ * ] Notice: The portion of the term of this patent subsequent to Oct. 8, 2008 has been disclaimed.

[21] Appl. No.: 654,827

[22] Filed: Feb. 13, 1991

Related U.S. Application Data

[63] Continuation-in-part of Ser. No. 399,599, Aug. 28, 1989, Pat. No. 5,054,174.

[30] Foreign Application Priority Data

Feb. 15, 1990 [DE] Fed. Rep. of Germany ..... 4004721

[51] Int. Cl.[5] ..... D02G 1/16; D02J 1/08

[52] U.S. Cl. ..... 28/271; 28/273

[58] Field of Search ..... 28/271, 273

[56] References Cited

U.S. PATENT DOCUMENTS

| | | | |
|---|---|---|---|
| Re. 32,047 | 12/1985 | Krenzer | 57/246 |
| 3,069,836 | 12/1962 | Dahlstrom et al. | 57/157 |
| 3,558,760 | 1/1971 | Olson | 28/271 |
| 3,892,020 | 7/1975 | Koslowski | 28/72.12 |
| 4,026,099 | 5/1977 | Phillips | 28/273 |
| 4,043,010 | 8/1977 | Gorrafa | 28/271 |
| 4,341,063 | 7/1982 | Southerlin et al. | 28/271 |
| 4,467,594 | 8/1984 | Eshenbach | 28/271 |
| 5,054,174 | 10/1991 | Krenzer | 28/271 |

FOREIGN PATENT DOCUMENTS 3210784 10/1984 Fed. Rep. of Germany .

*Primary Examiner*—Werner H. Schroeder
*Assistant Examiner*—Bibhu Mohanty
*Attorney, Agent, or Firm*—Bell, Seltzer, Park & Gibson

[57] ABSTRACT

A method and apparatus for producing an air textured yarn is disclosed, and wherein a partially oriented and fully drawn yarn is withdrawn from a supply package, wrapped about a heated godet, and then directly advanced into an air texturing nozzle. In the nozzle, a jet of unheated air serves to impart loops, curls, bows and the like to the advancing yarn. The yarn is advanced from the heated godet to the air jet nozzle under a relatively low tension so as to permit the heated yarn to shrink and thereby reduce the residual shrinkage. The jet of unheated air in the air jet nozzle also cools the yarn and thus the formation of the loops, etc. occurs only after shrinkage has ceased.

19 Claims, 1 Drawing Sheet

METHOD AND APPARATUS FOR PRODUCING AN AIR TEXTURED YARN

CROSS REFERENCE TO RELATED APPLICATION

This is a continuation-in-part of copending application Ser. No. 07/399,599, filed Aug. 28, 1989 now U.S. Pat. No. 5,054,174.

BACKGROUND OF THE INVENTION

The present invention relates to a method and apparatus for producing an air textured yarn having a relatively low residual shrinkage.

Methods and apparatus are known from German Patent 32 10 784, in which the yarn to be textured is supplied as a preoriented, thermoplastic yarn. The yarn is drawn in a draw zone and subsequently extended in an air nozzle to form loops, curls, bows and the like. The yarn produced has a residual shrinkage. The above referenced copending application Ser. No. 07/399,599 discloses a texturizing process wherein the yarn is drawn and heated, and then air jet texturized, and wherein the resulting air textured yarn has low residual shrinkage.

The present invention is based upon the recognition that the problem of the residual shrinkage also exists in air textured yarns which are supplied to the air texturing machine as already substantially fully drawn, fully oriented, thermoplastic yarns. In this regard, a substantially fully drawn yarn may be defined as having an extension at break of between about 7 to 20% and a tensile strength of about 6 to 8 cN/dtex for a technical filament yarn. Such yarn for textile use has an extension at break of between about 20 to 30% and a tensile strength of about 3 to 6 cN/dtex.

It is accordingly an object of the present invention to provide a method and apparatus for producing an air textured yarn, which has a low shrinkage, i.e. a slight residual shrinkage, from a fully oriented, fully drawn, thermoplastic yarn.

SUMMARY OF THE PRESENT INVENTION

The above and other objects and advantages of the present invention are achieved in the embodiments disclosed herein by the provision of a method and apparatus for producing an air texturized yarn and which includes the steps of guiding an advancing substantially fully drawn continuous filament yarn about a rotatable godet, while heating the godet so as to heat the yarn to a temperature which is higher than the second order transition temperature of the yarn. The advancing yarn is guided from said heated godet to an air jet nozzle while permitting the yarn to shrink and thereby reduce the residual shrinkage. A jet of unheated air is then applied to the advancing yarn while the advancing yarn passes through the air jet nozzle and so as to cool the yarn to a temperature below the second order transition temperature of the yarn, and to impart loops, curls, bows and the like to the cooled yarn. Finally, the advancing yarn is withdrawn from the air jet nozzle, and then wound into a package.

In a preferred embodiment, the advancing yarn loops several times about the heated godet, and the yarn is heated thereon to a temperature which is suitable to start the shrinkage for reducing the residual shrinkage, and which is higher than the second order transition temperature, preferably above about 80° C. From the heated godet, the yarn is withdrawn by the air jet nozzle and cooled in the nozzle to a temperature below the second order transition temperature, preferably below about 40° C. The yarn is withdrawn from the godet under a tension of less than about 0.1 cN/dtex, and after the nozzle, the yarn is deflected from the axis of the nozzle and withdrawn from the nozzle under little tension which should be less than 0.08 cN/dtex and preferably less than 0.05 cN/dtex, by a feed system downstream of the nozzle.

The present invention is based on the discovery that an air texturing apparatus which has a heating zone constructed as a heated roll and which directly precedes the texturing zone, is a suitable means for removing the residual shrinkage not only when preoriented yarns are supplied which are finish drawn on the air texturing machine, but also when fully drawn yarns are supplied, with this means being superior to all other known means both in its effect and because of the little technical resources and its good integration in the process sequence.

The present invention permits the residual shrinkage to be reduced to a much greater extent than in the previously discussed, known methods. The special advantage is that texturing is not adversely affected. Of particular importance in this regard is that an intensive heating of the yarn occurs. Consequently, the yarn can be heated to a temperature above the second order of transition, so that the crystalline structure, which is firmly anchored up to this temperature, softens and inner tensions diminish.

It is particularly advantageous to heat the godet to a temperature, which is slightly below the melting temperature of the yarn to be treated, i.e., to about 240° for polyamide 6.6 and polyethylene terephthalate, and to about 150° for polypropylene. On the other hand, however, the yarn is cooled in the air texturing nozzle to a very great extent, so that shrinkage is stopped and texturing occurs on the cold yarn.

The present invention represents a fortunate integration of the relaxation process into the air texturing process. More particularly, the yarn is heated before the inlet end of the texturing zone. The utilization of a heated godet permits an intensive heating and very low yarn tensions in the texturing zone, and thus a good shrinkage effect.

In comparison with yarns which are treated by the described known method of reducing the residual shrinkage, the tendency to residual shrinkage of the yarns treated according to the present invention is less than half. This results from the fact that the method of the present invention does not have the aforesaid limitations of the known methods because, according to the present invention, the shrinkage to be adjusted is not dependent on the speed difference in the relaxation zone (entry speed minus exit speed), and the yarn tension does not increase as a result of the occurrence of the shrinkage. Rather, the yarn tension to be adjusted and thus also the shrinkage are based alone on the tensile force of the air texturing nozzle.

The method of present invention is especially superior to all known methods in the texturing of multifilaments yarns with a denier higher than 500 dtex, in particular higher than 700 dtex, with the method and apparatus of the present invention being proposed in particular for the air texturing of carpet yarn, in particular carpet yarn of polypropylene having in particular a normal denier range of 130 dtex.

In this process it is necessary to consider that contrary to all known methods of reducing the residual shrinkage and contrary to all expectations, the present method is successful in particular with coarse deniers, whereas the known method permits a removal of the residual shrinkage in yarns with a coarse denier only within limits.

The method is especially favored in that the low yarn tensions of the texturing zone are differently adjusted, before and after the air texturing nozzle. In so doing, the yarn may be deflected to a great extent at the outlet of the air texturing nozzle, preferably by about 90°. This measure is contrary to the straight yarn path, which is normal in the entangling and also possible with air texturing nozzles.

As a result of the heat and shrinkage treatment according to the present invention, it will become possible to eliminate already prior to the actual texturing operation any irregularities of the previous drawing process by the intensive shrinkage treatment. It is thus possible to produce yarns having a great strength and the desired properties with regard to elongation and residual shrinkage.

The yarn tension decisive for the shrinkage is generated by the tensile force of the texturing nozzle. The tensile force of the texturing nozzle is again dependent on the speed of the yarn. The yarn speed is determined by the circumferential speed of the godet which precedes the texturing nozzle. The difference between the circumferential speed of the godet and the feed system subsequent to the texturing nozzle is not decisive for the shrinkage because, according to the present invention, this difference is always greater than the amount of the desired shrinkage. The latter is defined alone by the tensile force of the nozzle and by the influence of the temperature of the godet. Stated otherwise, the overfeed of the yarn in the texturing zone is always greater than the shrinkage adjusted by the tensile force of the nozzle and the temperature of the godet. Thus, the overfeed $0=(v5-v10)\times 100:v10$, with $v10$=circumferential speed of the feed system subsequent to the texturing nozzle; and $v5$=circumferential speed of the godet. The shrinkage is expressed by the equation $S=(L1-L2)\times 100:L1$, with $L1$=original length of the yarn; and $L2$=length of the yarn after the shrinkage.

As a result of the fact that the overfeed is greater than the adjusted shrinkage, it is accomplished that the yarn can be crimped in the desired manner. The difference between overfeed and adjusted shrinkage is 1–10% for industrial yarns, in which texturing serves in particular the purpose of roughening the yarn, so as to improve, for example, its running capability (sewing threads) or its adhesion to other materials (industrial fabrics, tire cord).

The difference between overfeed and adjusted shrinkage ranges from 10 to 300% for textile yarns. What matters in the case of textile yarns is to influence appearance, touch, bulkiness and other properties in such a manner as is desired for clothing and other textile uses.

An advantage of the present invention is the fact that it is necessary to modify a standard air texturing machine only slightly in order to incorporate the present invention.

As to the disadvantages of the state of the art and the further advantages of the present invention, reference is made to the above referenced copending application Ser. No. 07/399,599, which, as far as these are concerned, is incorporated herein by reference.

The air texturing method of the present application is understood to be a method, in which a continuous, synthetic yarn, which comprises a plurality of individual filaments, is subjected to the action of an air texturing nozzle. In the air texturing nozzle, an unheated air jet is blown onto the yarn. As a result, the individual filaments are deformed to loops, curls, bows and the like, without thereby changing substantially the chemophysical structure of the filaments. Thus, the filaments extending substantially parallel at first, are only geometrically relocated in an irregular form, thereby forming in particular loops, curls, and bows. A particularly suitable method of producing high-quality yarn is disclosed in German Patent 27 49 867 and corresponding U.S. Pat. No. Re. 32,047. Suitable nozzles are shown, for example, in the article entitled "Die Texturierung von Filamentgarnen im Luftstrom" by Bock, Aachen 1984/1985.

In the context of the present application the following terminology, which is typical, will be used: Residual shrinkage is the tendency of the yarn to shrink (shrinkage tendency) when being heated, for example by hot air or hot water.

Shrinkage is a shortening of the yarn, which occurs in fact when it is heated, and which is expressed by the formula $(L1-L2)\times 100:L1\%$, with $L1$ being the original and $L2$ the shortened length of the yarn. The shrinkage cannot be greater than the previously existing residual shrinkage. However, a residual shrinkage can still remain despite the shrinkage.

If the known method is applied, the residual shrinkage, i.e., the tendency to shrink can be reduced only by a suitable aftertreatment subsequent to the process. Although it is possible to reduce the residual shrinkage of the yarn by such measures for aftertreatment of the shrinkage, these measures, however, have considerable disadvantages. This applies particularly to textured yarns, since the aftertreatment subsequently affects or even damages the crimp. Primarily, a shrinkage treatment can be carried out intensively only when the yarn is subjected to "contact heating," i.e. when the yarn passes over a hot plate or a heated godet. However, this procedure is generally not suitable for textured yarns, because it results in an ironing effect. This means that a previously imparted yarn texture is again removed in part, primarily on one side of the yarn, by its contact with the hot surface.

A method of aftertreatment for the purpose of reducing the shrinkage of an air textured yarn is known from U.S. Pat. No. 3,892,020 which corresponds to DE-OS 24 59 102. In this process, the air textured yarn is wound onto a very soft package under little tension of less than 0.4 grams/denier. This package is subsequently dyed in a heated dye liquor. As a result thereof a shrinkage is started, and the residual shrinkage remaining in the yarn is reduced accordingly. However, this method is not adapted to carry out the treatment for reducing the residual shrinkage on an air texturing machine. Particularly disadvantageous is that the package must be wound under a low yarn tension, which adversely affects the transportability of the package. Furthermore, the package and the yarn are damaged by the increased yarn tension, which builds as the shrinkage becomes effective.

The residual shrinkage can also be reduced prior to texturing. To this end, it is known that a thermoplastic drawing process of thermoplastic yarns can be followed by a treatment for reducing shrinkage in a relaxation zone. The relaxation zone follows the actual draw zone, and is formed between two godets or feed systems, with the yarn being heated in the relaxation zone. As a result thereof the length of the yarn path and thus the height of the air texturing machine is necessarily increased. Primarily, however, this relaxation treatment will always result in the problem that the reduction of the shrinkage in such a relaxation zone has its limits, inasmuch as the tension of a yarn traveling between godets cannot be reduced to any desired extent, and consequently the shrinkage is dependent on the limited speed difference of the godets.

The above is based on the fact that a yarn must always advance in a straight line between two feed systems and consequently be under a certain minimum tension. The shrinkage which occurs in fact results from the state of equilibrium between the shrinkage tendency on the one hand and the yarn tension on the other.

A method of reducing residual shrinkage, in which a multifilament yarn is simultaneously interlaced or entangled, is disclosed in U.S. Pat. No. 3,069,836. In this method, the yarn, which is first drawn between two godets assisted by an unheated draw pin, passes through a relaxation zone, in which the entry speed is greater than the exit speed. While in the relaxation zone, the yarn passes through a nozzle, which is supplied by a heated gas. The shrinkage which is thus accomplished is, as aforesaid, dependent on the difference of these speeds. The application of hot air serves both to produce a shrinkage and to make a yarn which has its filaments entangled. The method is not suitable for producing a crimp, because it will produce a yarn whose filaments are chemophysically changed in their inner structure by the action of heat during the air texturing operation. Even if curls and loops were produced in the filaments, such a crimp of this yarn would not be stable. This means that this crimp would again be removed from the yarn by the application of tensile forces. Tensile forces, which suffice to remove this crimp, however, occur already as a result of the shrinkage in the relaxation zone, as well as also during the aftertreatment by subsequent stabilizing and heat setting processes, which are provided, according to U.S. Pat. No. Re. 32,047, for improving the length stability of the yarn, and in particular in weaving and knitting. As a result, such a yarn would not be usable as a crimped yarn.

BRIEF DESCRIPTION OF THE DRAWINGS

Some of the objects and advantages of the present invention having been stated, others will become apparent as the description proceeds, when taken in association with the following drawings in which.

DETAILED DESCRIPTION OF THE PREFERRED EMBODIMENTS

Figure 1:
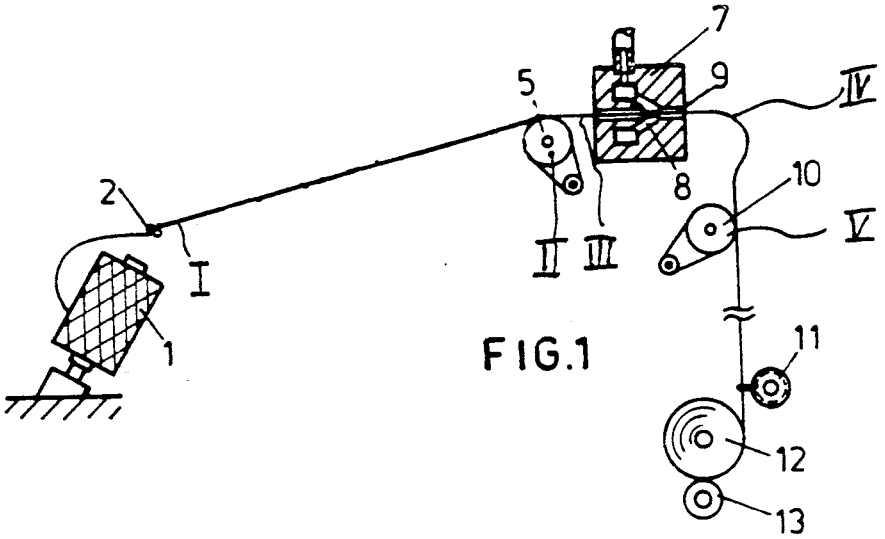
FIG. 1 is a schematic illustration of a method and apparatus for producing a texturized yarn in accordance with the present invention.

Referring more particularly to the drawings, FIG. 1 discloses an apparatus for practicing the present invention and wherein a substantially fully drawn and oriented yarn is unwound from a supply package 1 and advanced through a yarn guide 2 by a driven and heated feed godet 5. After the godet 5, the yarn passes through an air texturing nozzle 7, which is supplied with unheated compressed air. Thus, when the yarn undergoes the air texturing treatment, it is by no means heated to its deformation point. Consequently, the deformations generated by the air texturing treatment do not affect the chemophysical structure of the yarn. Upon its impact on the yarn, the air expands and consequently cools down further. As the air jet expands, the individual filaments of the multifilament manmade yarn are blown into loops, curls, bows, and the like. These are only geometrical deformations, which interlace and entangle, thereby forming the texture of the yarn.

It should be emphasized that the air, which is supplied to the texturing nozzle, is unheated and has a temperature which is less than the temperature at which the crystalline structure of the yarn freezes, and consequently any shrinkage comes to a standstill. Normally, the air temperature is below 40° C. As the air expands, it is cooled further, and the air which leaves the nozzle has a temperature of less than 10° C. Taking into account that the texturing nozzle is operated by compressed air under a pressure of between 6 and 10 bar, the yarn previously heated by the godet 5 is likewise considerably quenched in the texturing nozzle at the same time, so that its temperature also drops below the temperature at which its crystalline structure freezes. Consequently, it should be understood that the yarn is cooled by the air texturing nozzle, thereby bringing the shrinkage to a standstill. This has the advantage that texturing by the formation of loops, curls, bows and the like occurs only when shrinkage has come to a standstill. Consequently, texturing is no longer affected or influenced by the shrinkage. This is significant, inasmuch as the production of an air textured yarn with a good length stability after texturing makes it necessary to first exert a tensile force on the yarn before the latter is compacted by subsequent further heat and shrinkage treatments. To this extent, reference is made to German Patent 27 49 867 and corresponding U.S. Pat. Re. No. 32,047. As a result, the method of the present invention is a significant supplement to the known method.

As is schematically illustrated, the air channels 8, which are directed in the texturing nozzle 7 to a yarn channel 9, have a directional component in the direction of the yarn path. This allows the air texturing nozzle 7 to also exert an advancing effect and a tensile force on the yarn. The yarn leaves the air texturing nozzle 7 substantially under no tension, and the yarn is then deflected and guided to a feed system 10. The deflection ranges from 30° to 90°, preferably 90°, and is accomplished in that the feed system 10 does not extend along the axis of the yarn channel 9, but is laterally displaced therefrom. Consequently, the deflection does not occur by reason of the yarn traveling over a yarn guide, but rather the yarn leaving the air channel first continues to be advanced by the air jets in a straight line and must then change its direction toward the feed system 10. This type of deflection results in a substantial decrease of the yarn tension. Consequently, the yarn tension is higher between the godet 5 and the texturing nozzle 7 than the yarn tension, which increases again after the texturing nozzle 7 after the deflection and before the feed system 10. The yarn tensions before and after the air texturing nozzle amount, for example, to 6 cN and 5 cN.

Located downstream of the feed system 10 is a suitable yarn treatment means, such as is particularly known from German Patent 27 49 867 and corresponding U.S. Pat. No. Re. 32,047. More specifically, the yarn can be drawn in a stabilizing zone between two godets without any elastic or plastic deformation and without being heated. Alternatively or preferably subsequent to the stabilization, the yarn can be guided through a setting zone at temperatures up to 245° C. The successive arrangement of a stabilizing zone and a setting zone results in a particularly compact yarn of little instability. Subsequently, the yarn is reciprocated transversely to its direction of advance by a traversing mechanism 11, and wound on a package 12. The package 12 is driven by a friction roll 13 at a constant circumferential speed.

According to the invention, the godet 5 is heated. When relaxing polyamide, polyester, and polyethylene terephthalate yarns the temperature of the godet 5 is about 200°-245° C., and about 150° C. for polypropylene.

In the case of polyamide yarns, i.e., nylon and perlon yarns, a cold drawing is possible in accordance with the normal practice. In so proceeding, the yarns are looped about a draw pin, which is not supplied with heat from an external source. The method of the present invention primarily enables the treatment of such cold drawn yarns, and has turned out to be efficient in such a manner that also cold drawn polyester yarns, in particular of polyethylene terephthalate, can be processed from a supply package. Even when processing cold drawn polyester yarns, which have very poor textile properties after the drawing, the method of the present invention allows to adjust good strength and elongation properties and to achieve thus a residual shrinkage behavior, which cannot be obtained by other methods. The method proves to be particularly efficient, when the cold drawing occurs on preoriented yarns, which are withdrawn from the spinning zone at high spinning speeds.

The tests according to the parent application were analogously carried out likewise for the discontinuous method of the present invention.

The test parameters and the test results are shown in the following table. In the test, the yarns had at first a spinning denier of 410 dtex and a yield point of 180%, before they were fully oriented by drawing at a ratio of 1:1.95 or respectively 1:2.3 for the industrial yarn and wound to the supply package 1.

TABLE

| POY PES Measuring Point | Processing Variable | Textile Yarn | Industrial Yarn |
|---|---|---|---|
| I | Residual shrinkage (at 177° C.) | 10% | 12% |
| I | Elongation E | 18% | 8% |
| I | Draw denier | 210 dtex | 178 dtex |
| II | Speed v5 % | 100% | 100% |
| II | Temperature of draw roll T5 | 190° C. | 240° C. |
| III | Yarn tension S1 | 7.0 cN | 6.8 cN |
| IV | Yarn tension S2 | 6.0 cN | 5.8 cN |
| IV | Yarn temperature | ≦40° C. | ≦40° C. |
| V | Overfeed | (7 + 20)% | (7 + 4)% |
| V | Speed v10 | 79% | 90% |
| VI | Residual shrinkage S (at 177° C.) | 1.8% | 2.% |
| VI | Elongation E | 25% | 14% |

Figure 2:
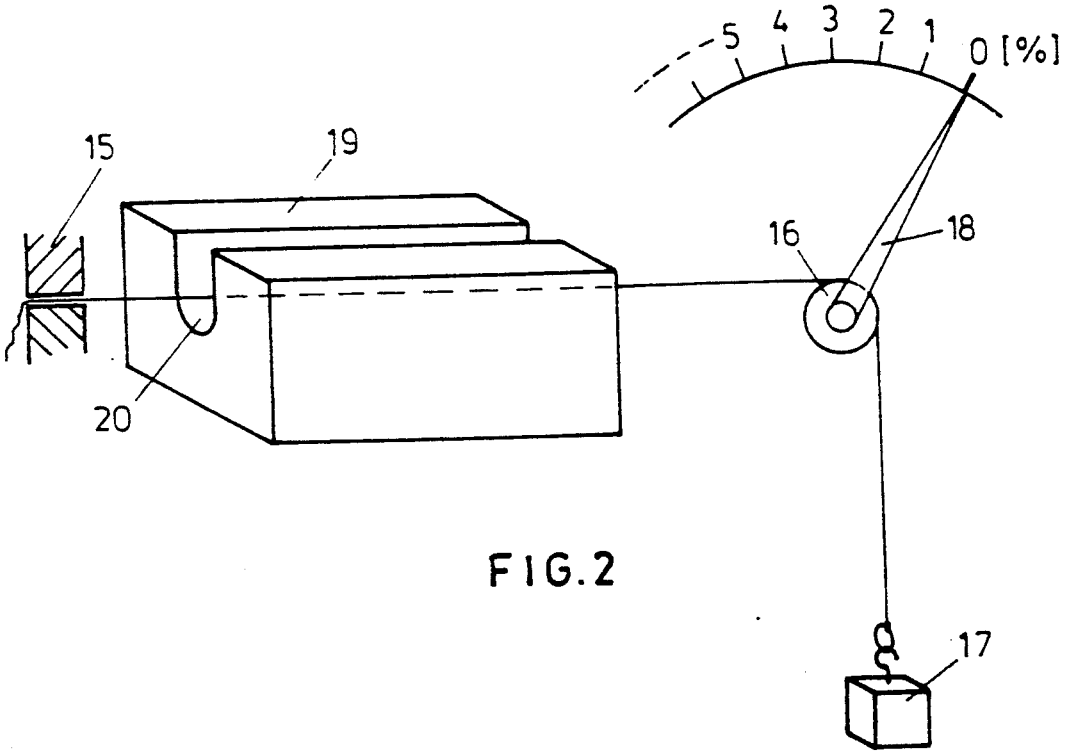
FIG. 2 is a schematic representation of a device for measuring the residual shrinkage of yarn.

FIG. 2 illustrates a suitable apparatus for a quick measurement of the residual shrinkage. Such an apparatus is commercially available under the trademark TESTRITE TM. This instrument is used especially for comparative tests, and allows the percentage (L1−L2: L1×100) to be determined, by which a pretreated yarn shrinks, when it is subjected to the shrinkage treatment on the TESTRITE TM instrument at the same clamping length, at the same heating length, as well as under the same yarn tension.

The yarn is firmly secured at one end 15 and guided over a measuring roll 16 at the other end. After the measuring roll 16, the yarn is loaded by a weight 17. The measuring roll is connected with a needle 18, so that a change in the yarn length is indicated on a scale. The yarn is heated by a heater 19 with a yarn slot 20. It results from general testing principles that when a test is run, the treatment time, the clamping length of the yarn between clamp 15 and measuring roll 16, the length of the heater 19, the temperature of the heater 19, and the weight 17 remain constant.

In the drawings and specification, there have been disclosed typical preferred embodiments of the invention and, although specific terms are employed, they are used in a generic and descriptive sense only and not for purposes of limitation, the scope of the invention being set forth in the following claims.

I claim:

1. A method of producing an air textured yarn having a relatively low residual shrinkage, and comprising the steps of guiding an advancing substantially fully drawn continuous filament yarn about a rotatable godet, heating the godet so as to heat the yarn to a temperature which is higher than the second order transition temperature of the yarn, guiding the advancing yarn from said heated godet to an air jet nozzle while permitting the yarn to shrink and thereby reduce the residual shrinkage, applying a jet of unheated air to the advancing yarn while passing the advancing yarn through said air jet nozzle and so as to cool the yarn to a temperature below the second order transition temperature of the yarn, and to impart loops, curls, bows and the like to the cooled yarn, withdrawing the advancing yarn from said air jet nozzle, and then winding the advancing yarn into a package.

2. The method as defined in claim 1 wherein the heating step includes heating the yarn to a temperature above about 80 degrees C., and the step of applying a jet of unheated air to the yarn includes cooling the yarn to a temperature below about 40 degrees C.

3. The method as defined in claim 2 wherein the step of withdrawing the advancing yarn from the air jet nozzle includes withdrawing the same under a tension of less than bout 0.08 cN/dtex.

4. The method as defined in claim 3 wherein the step of guiding the advancing yarn from said heated godet includes withdrawing the advancing yarn from the heated godet under a tension of less than about 0.1 cN/dtex, and the step of withdrawing the advancing yarn from said air jet nozzle includes withdrawing the same under a tension of less than about 0.05 cN/dtex.

5. The method as defined in claim 4 wherein the step of withdrawing the advancing yarn from the air jet nozzle comprises deflecting the advancing yarn immediately upon leaving said air jet nozzle by an angle of between about 30 to 90 degrees from its direction of travel through said air jet nozzle, and then engaging the deflected yarn with a rotating feed roll.

6. The method as defined in claim 1 wherein the step of applying a jet of air to the advancing yarn includes directing the jet of air so as to impart a force to the yarn in the advancing direction, and wherein said godet is rotated at a speed so as to impart an overfeed to the advancing yarn during the advance of the yarn from said godet to said air jet nozzle.

7. The method as defined in claim 6 wherein said overfeed is between about 1 to 10% greater than the shrinkage imparted to the yarn in said air jet nozzle, and such that the produced yarn is adapted for industrial uses.

8. The method as defined in claim 6 wherein said overfeed is between about 10 to 300% greater than the shrinkage imparted to the yarn in said air jet nozzle, and such that the produced yarn is adapted for textile uses.

9. The method as defined in claim 1 wherein the step of applying a jet of unheated air to the advancing yarn includes cooling the yarn to an extent such that shrinkage comes to a standstill and the loops, curls, bows and the like are imparted without affecting the chemophysical structure of the yarn.

10. A method of producing an air textured yarn having a relatively low residual shrinkage, and comprising the steps of withdrawing a substantially fully drawn continuous filament yarn from a supply package and advancing the yarn along a path of travel, heating the advancing yarn to a temperature which is higher than the second order transition temperature of the yarn, guiding the heated yarn to an air jet nozzle while permitting the heated yarn to shrink and thereby reduce the residual shrinkage, applying a jet of unheated air to the advancing yarn while passing the advancing yarn through said air jet nozzle and so as to cool the yarn to a temperature below the second order transition temperature of the yarn, and to impart loops, curls, bows and the like to the cooled yarn, withdrawing the advancing yarn from said air jet nozzle, and then winding the advancing yarn into a package.

11. The method as defined in claim 10 wherein the step of guiding the heated yarn to an air jet nozzle includes guiding the advancing yarn under a tension of less than about 0.1 cN/dtex, and the step of withdrawing the advancing yarn from said air jet nozzle includes withdrawing the same under a tension of less than about 0.05 cN/dtex.

12. The method as defined in claim 11 wherein the step of withdrawing the advancing yarn from the air jet nozzle comprises deflecting the advancing yarn immediately upon leaving said air jet nozzle by an angle of between about 30 to 90 degrees from its direction of travel through said air jet nozzle, and then engaging the deflected yarn with a rotating feed roll.

13. The method as defined in claim 10 wherein the step of applying a jet of air to the advancing yarn includes directing the jet of air so as to impart a force to the yarn in the advancing direction, and imparting an overfeed to the advancing yarn during the advance of the yarn to said air jet nozzle.

14. The method as defined in claim 13 wherein said overfeed is between about 1 to 10% greater than the shrinkage imparted to the yarn in said air jet nozzle, and such that the produced yarn is adapted for industrial uses.

15. The method as defined in claim 13 wherein said overfeed is between about 10 to 300% greater than the shrinkage imparted to the yarn in said air jet nozzle, and such that the produced yarn is adapted for textile uses.

16. The method as defined in claim 10 wherein the substantially fully drawn continuous filament yarn has an extension at break of between about 7 to 30% and a tensile strength of between about 3 to 8 cN/dtex.

17. The method as defined in claim 10 wherein the step of applying a jet of unheated air to the advancing yarn includes cooling the yarn to an extent such that shrinkage comes to a standstill, and the loops, curls, bows and the like are thereafter mechanically imparted by contact of the air jet with the cooled yarn.

18. An apparatus for producing an air textured yarn having a relatively low residual shrinkage, and comprising means for withdrawing a yarn from a supply package and conveying the same along a patch of travel, means positioned along said path of travel for heating the advancing yarn to a predetermined temperature, said yarn heating means comprising a rotatable godet about which the advancing yarn is adapted to be wound, and means for heating said godet, air jet nozzle means positioned along said path of travel downstream of said heating means for applying a jet of unheated air to the advancing yarn so as to impart loops, curls, bows and the like to the advancing yarn, means for withdrawing the advancing yarn from said air jet nozzle, and means for winding the yarn withdrawn from said air jet nozzle into a package.

19. The apparatus as defined in claim 18 further comprising drive means for positively rotating said godet at a predetermined rotational speed.

* * * * *